United States Patent [19]

Matsui

[11] 4,297,978

[45] Nov. 3, 1981

[54] IDLING ROTATIONAL SPEED CONTROL SYSTEM FOR A DIESEL ENGINE

[75] Inventor: Katsuhiko Matsui, Yokohama, Japan

[73] Assignee: Nissan Motor Company, Limited, Yokohama, Japan

[21] Appl. No.: 107,458

[22] Filed: Dec. 26, 1979

[30] Foreign Application Priority Data

Jan. 18, 1979 [JP] Japan ..... 54-3359

[51] Int. Cl.[3] ..... F02M 51/06

[52] U.S. Cl. ..... 123/339; 123/340; 123/353

[58] Field of Search ..... 123/339, 340, 352, 353, 123/354, 355, 362, 368

[56] References Cited

U.S. PATENT DOCUMENTS

| | | | |
|---|---|---|---|
| 3,659,571 | 5/1979 | Lang | 123/102 |
| 3,889,647 | 6/1975 | Rachel | 123/353 |
| 3,964,457 | 6/1976 | Coscia | 123/339 |
| 3,998,191 | 12/1976 | Beyerlein et al. | 123/353 |
| 4,174,694 | 11/1979 | Wessel et al. | 123/340 |
| 4,203,395 | 5/1980 | Cromas et al. | 123/339 |
| 4,223,654 | 9/1980 | Wessel et al. | 123/340 |

FOREIGN PATENT DOCUMENTS

| | | |
|---|---|---|
| 1040838 | 10/1958 | Fed. Rep. of Germany . |
| 1961438 | 7/1970 | Fed. Rep. of Germany . |

*Primary Examiner*—Charles J. Myhre
*Assistant Examiner*—R. A. Nelli
*Attorney, Agent, or Firm*—Lane, Aitken, Kice & Kananen

[57] ABSTRACT

A diesel engine control system comprises an engine speed circuit for controlling the engine so that the rotational speed of the engine when idling is at least the required minimum rotational speed suited to the determined engine speed, engine temperature, and battery condition. Thereby, the engine control system makes it possible to control the rotational speed of the engine automatically when idling without manual operation.

18 Claims, 3 Drawing Figures

IDLING ROTATIONAL SPEED CONTROL SYSTEM FOR A DIESEL ENGINE

DETAILED DESCRIPTION OF THE PRESENT INVENTION

The present invention relates to a rotational speed control system for a diesel engine, and more particularly to a diesel engine control system capable of automatically controlling the rotational speed of the engine at the time of idling.

In the prior art, in a vehicle in which a diesel engine is mounted, for instance, to warm up the engine when it is idling, the driver manually operates a control lever connected to a fast idle mechanism to increase the fuel supplied to the engine by a fuel injection pump, thereby stepping up the rotational speed of the engine.

However, the manual operation of the control lever is trouble-some. Further, it is very difficult to precisely step up the rotational speed of the engine to the predetermined rotational speed required when idling on the basis of the driver's own judgement.

While the engine is idling, it happens frequently that it is necessary to operate an accessory, such as an air conditioner which consumes a lot of power. Further, it may happen that idling of the engine is required when the battery voltage is below a predetermined level. In either case, it is necessary to increase the rotational speed of the engine. However, the conventional rotational control system makes it necessary to operate the lever manually or continue to press the accelerator pedal.

SUMMARY OF THE INVENTION

With the above in mind, an object of the invention is to provide a rotational speed control system for a diesel engine which makes it possible to automatically control the engine so that the determined rotational speed becomes the predetermined idling speed setting value, for instance, in the case of warming the engine by idling.

Another object of the invention is to provide a rotational speed control system for a diesel engine which, when the engine is idling and the engine temperature or the battery condition is abnormal, makes it possible to control the engine so that the rotational speed of the engine becomes the predetermined speed.

A further object of the invention is to provide a rotational speed control system for a diesel engine which eliminates manual operation relying on the driver's judgement, thereby making it possible to precisely step up the rotational speed of the engine to the predetermined idling speed.

A still further object of the invention is to provide a rotational speed control system for a diesel engine which makes it possible to shorten the time required for warming-up, and prevent excessive discharge of the battery, or overheating of the engine.

BRIEF DESCRIPTION OF THE DRAWINGS

The feature and advantages of a rotational speed control system for a diesel engine according to the present invention will become more apparent from the following description taken in conjunction with the accompanying drawings, in which.

In these drawings, the same reference numerals indicate the same or similar elements of the rotational speed control system for a diesel engine according to the present invention.

DETAILED DESCRIPTION OF THE PREFERRED EMBODIMENT

A preferred embodiment of the present invention will now be described in detail, for the purposes of explanation.

Figure 1:
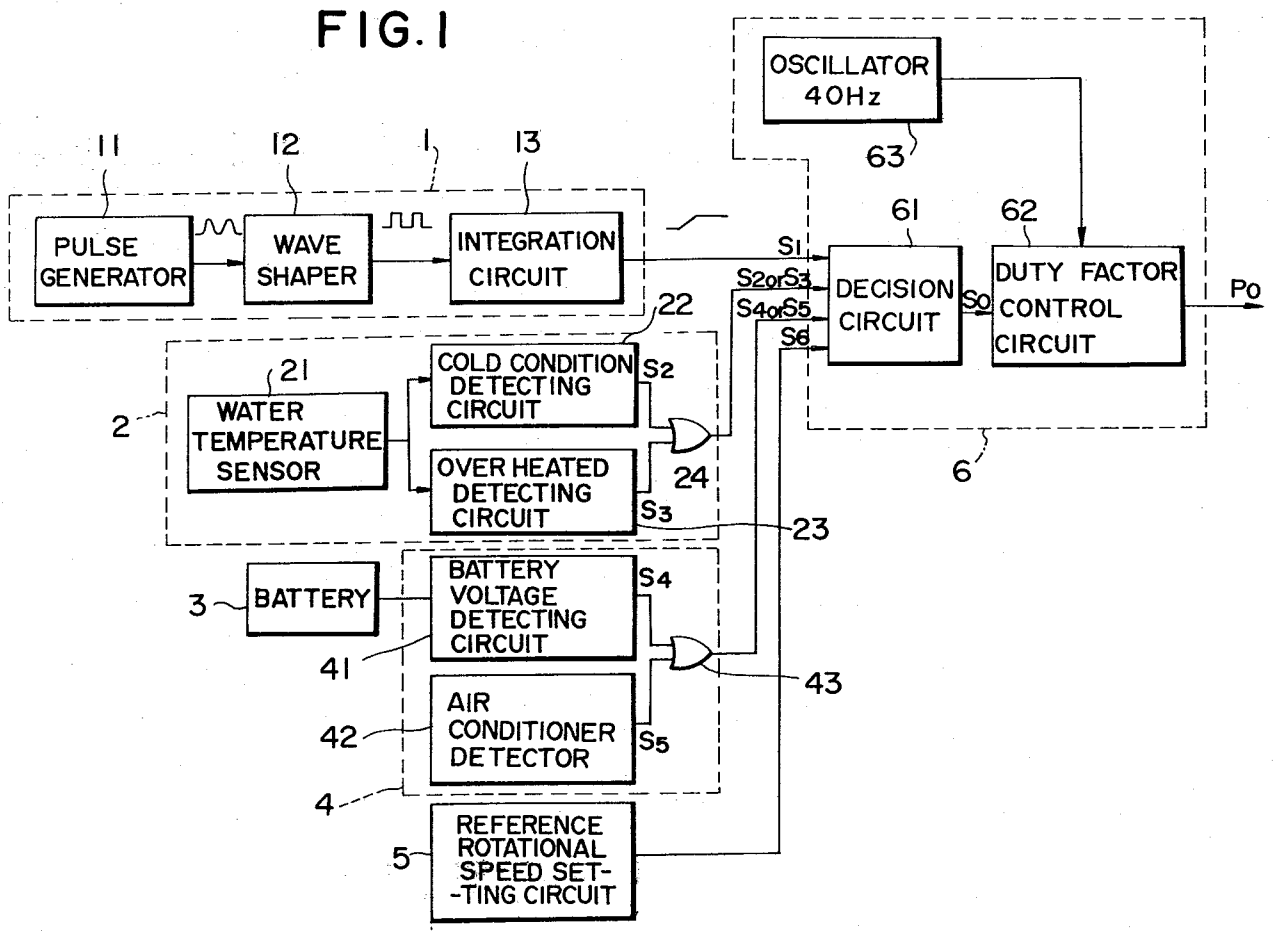
FIG. 1 is a block diagram illustrating an example of a control circuit employed in a rotational speed control system for a diesel engine according to the present invention.
Figure 2:
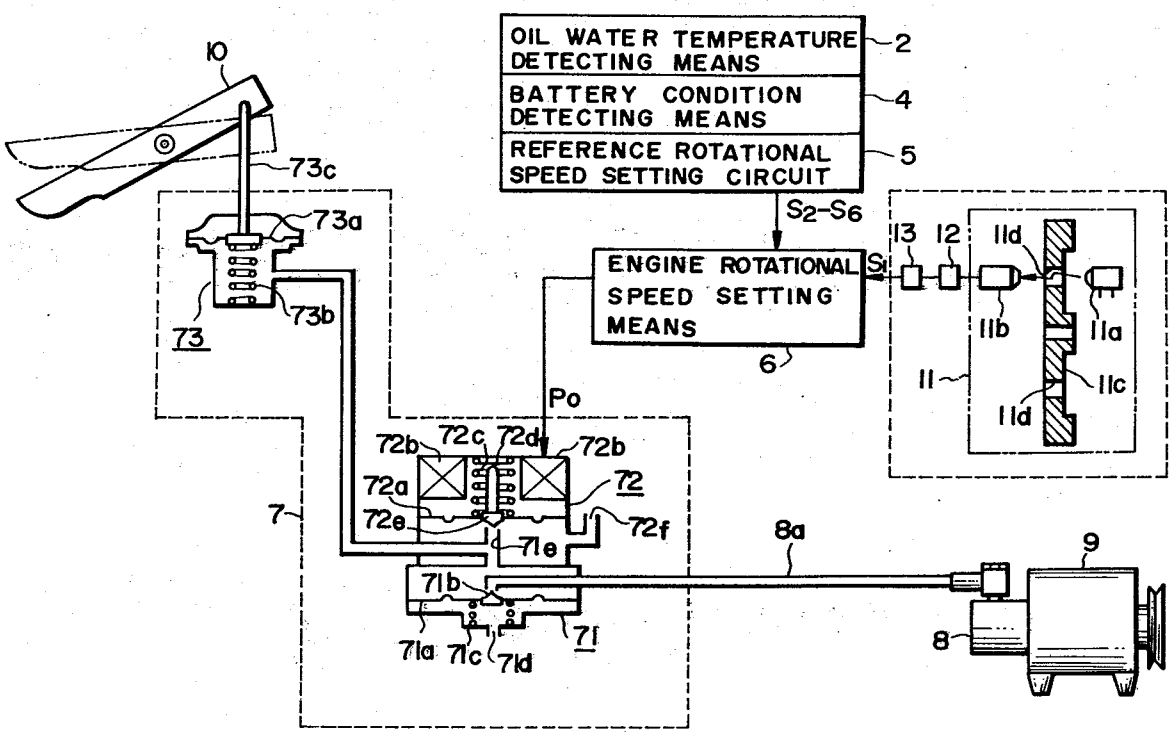
FIG. 2 is a block schematic view illustrating a rotational speed control system for a diesel engine according to the present invention.

Referring to FIG. 1, reference numeral 1 denotes an engine rotational speed sensor which senses the rotational speed of an engine (not shown) to produce a signal $S_1$ corresponding to the rotational speed of the engine. The engine rotational speed sensor 1 includes a pulse generator 11 comprising as best shown in FIG. 2, a light source 11*a*, a photocell 11*b*, and an injection pump pulley 11*c* which is disposed between the light source 11*a* and the photocell 11*b* and rotates in synchronism with the engine. Slits 11*d* are formed in the injection pump pulley 11*c*. The pulse signal generator further comprises a wave shaping circuit 12 which suitably shapes the pulse signal outputted from the photo receiving element 11*b* to produce the desired rectangular waveform, and an integration circuit 13 which converts the output of the wave shaping circuit 12 into a voltage corresponding to the frequency of the signal.

In practice, the rotational speed of the injection pump pulley 11*c* may be set to, for example, one half of that of the engine.

Reference numeral 2 denotes a temperature sensor which senses the temperatures of the oil or water in the engine. The temperature sensor 2 comprises a water temperature sensor 21, such as a thermistor, which detects the temperature of cooling water of the engine, a cold condition detecting circuit 22 producing an output signal $S_2$ when the water temperature is below 20° C., and an overheating condition detecting circuit 23 producing an output signal $S_3$ when the water temperature is above 110° C., and an OR gate 24 connected to the outputs of the cold condition detecting circuit 22 and the overheating condition detecting circuit 23. In place of or in addition to the water temperature sensor 21, an oil temperature sensor may be used to sense the temperature of the engine oil.

Reference numeral 4 denotes a battery condition sensor which senses the voltage of a battery 3 and the load condition of the battery 3. The battery condition sensor circuit 4 comprises a battery voltage sensing circuit 41 producing an output signal when the output voltage of the battery 3 is below 10 V, and an air conditioner operation detector 42 producing an output signal $S_5$ when the air conditioner is switched on, and an OR gate connected to the outputs of the battery voltage sensing circuit 41 and the air conditioner detector 42.

Reference numeral 5 denotes a reference speed setting circuit producing an output signal $S_6$ for setting the rotational speed of the engine when idling in normal conditions. Reference numeral 6 denotes an engine speed setting circuit which determines on the basis of input signals, a required engine speed if this engine speed is above a predetermined minimum. These input signals are: the output signal $S_1$ of the engine speed sensor 1, the output signals $S_2$ and $S_3$ of the temperature sensor 2, the output signals $S_4$ and $S_5$ of the battery condition sensor 3, and the output signal $S_6$ of the reference rotational speed setting circuit 5.

The engine rotational speed setting circuit 6 comprises a decision circuit 61 producing an output signal So of which the value is determined on the basis of the input signals $S_1$ to $S_6$, a rectangular wave generator 63 producing a rectangular wave signal of which the frequency is 40 Hz, and a duty factor control circuit 62 responsive to the output signal So to change the duty factor of the rectangular wave signal inputted from the rectangular wave generator 63. More particularly, the decision circuit 61 has three actions. The first is to set the value of the output signal $S_0$ so that the rotational speed of the engine is at least 1,200 r.p.m. when the input signal $S_2$ or $S_3$ is inputted thereto. The second is to set the value of the output signal $S_0$ so that the rotational speed of the engine is at least 900 r.p.m. when the input signal $S_4$ or $S_5$ is inputted thereto. The third is to set the value of the output signal $S_0$ so that the rotational speed of the engine is 650 r.p.m.

Referring to FIG. 2, reference numeral 7 denotes a driving means controlled by the pulse signal $P_0$ outputted from the engine speed setting circuit 6, which actuates a control lever 10 of a fuel injection pump not shown.

More particularly, the driving means 7 comprises a control valve consisting of a regulating pressure control valve 71 to which a vacuum pressure is supplied, and a duty factor control solenoid valve 72 which controls an output vacuum by varying the ratio between the constant vacuum pressure regulated by the regulating control valve 71 and air in accordance with the duty factor of the pulse signal $P_0$.

The driving means 7 further comprises an actuator 73 which becomes operative in accordance with a stroke corresponding to the output vacuum from the control valve 7 to actuate the control lever 10.

In the regulating pressure control valve 71, reference numeral 71*a* denotes a diaphragm, 71*b* a valve provided in the diaphragm 71*a* so as to face the opening of a pipe 8*a* to communicate with a vacuum pump 8, 71*c* a spring for biasing the diaphragm 71*a* downwardly, and 71*d* an opening exposed to air.

In the duty factor control solenoid valve 72, reference numeral 72*a* denotes a diaphragm, 72*b* a solenoid, 72*c* a spring for biasing the diaphragm 72*a* upward so as to open the valve 72*e*, 72*d* a plunger fixed on the valve 72*e* mounted in the diaphragm 72*a*, and 72*f* an opening exposed to air.

The actuator 73 comprises a diaphragm 73*a*, a spring 73*b* for biasing the diaphragm 73*a* upwardly and a driving rod 73*c* one end of which is fixed to the diaphragm 73*a* while the other end is fixed to the control lever 10.

The vacuum pump 8 is driven together with a generator 9 by the engine.

Figure 3:
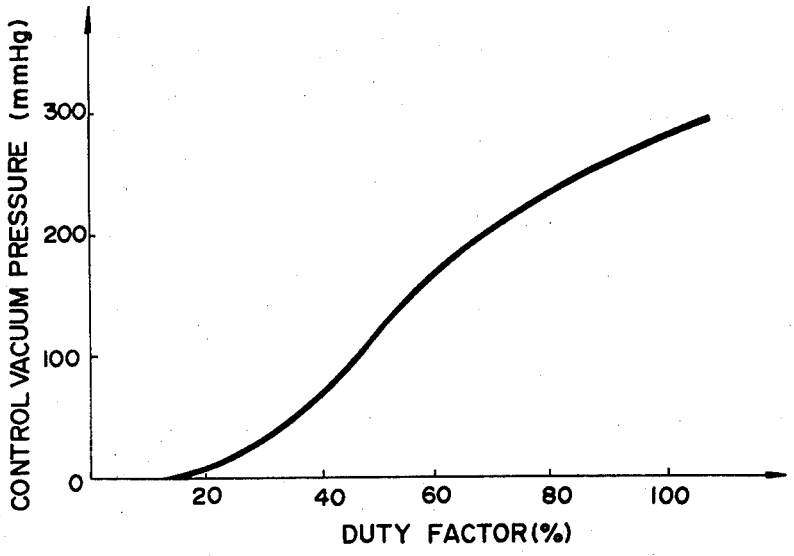
FIG. 3 is a graph illustrating the relationship between a duty factor of a pulse signal and a control vacuum pressure being supplied to an actuator.

FIG. 3 shows a graph illustrating a relationship between a duty factor (pulse width/period) of the pulse signal $P_0$ and a vacuum pressure supplied to the actuator 73.

The operation of the preferred embodiment of the present invention will now be described.

Reference is first made to the case where the engine temperature and battery conditions are normal.

When the engine is started, and is idling, the pulley 11*c* shown in FIG. 2 rotates in synchronism with the engine. Then, light emitted from the light source 11*a* is intermittently interrupted by the rotating slit 11*d*. The photocell 11*b* receives the beam to produce a pulse train having a frequency proportional to the speed of the engine. The pulse train signal is converted into a rectangular pulse by a wave shaping circuit 12 shown in FIG. 1, and then the rectangular pulse is inputted to an integration circuit 13. The integration circuit 13 changes the frequency of the rectangular pulse signal into a corresponding voltage to supply the decision circuit 61 with an output signal $S_1$ corresponding to the speed of the engine.

The decision circuit 61 compares this signal $S_1$ with a signal $S_6$ outputted from the reference speed setting circuit 5 to feed an output signal $S_0$ to the duty factor control circuit 62 so that the rotational speed of the engine is maintained at about 650 r.p.m. In this duty factor control circuit 62, control is effected by the signal $S_0$ so that the duty factor of a rectangular pulse having a frequency of 40 Hz is inputted from the oscillator 63 is zero. Thus, a zero duty factor pulse signal $P_0$ is supplied to the solenoid 72*b* of the duty factor control solenoid valve 72 shown in FIG. 2.

The solenoid 72*b* is not rendered operative by a signal of which the duty factor is zero. Accordingly, the diaphragm 72*a* of the solenoid valve 72 is held at the upper position by the force of the spring 72*c*. The valve 72*e* is positioned away from the opening 71*e* of the constant pressure control valve 71. Accordingly, although the regulated vacuum pressure (about 300 mmHg) is supplied from the vacuum pump 8 to the solenoid valve 72 and regulated by the regulating pressure control valve 71 comprising the spring 71*c* and the valve 71*b* provided in the diaphragm 71*a*, the chamber of the solenoid valve 72 is substantially open to the atmosphere through the opening 72*f*. As is clear from FIG. 3, the vacuum pressure is not supplied to the actuator 73. As a result, the diaphragm 73*a* of the actuator 73 is held at the upper position by the force of the spring 73*b*. Accordingly, the driving rod 73*c* does not render the control lever 10 operative. The fuel injection pump continues to supply a predetermined amount of fuel into the engine, with the result that the engine idles at 650 r.p.m.

Meanwhile, if when idling the temperature measured by the temperature sensor 21 is below 20° C., the cold condition detecting circuit 22 produces an output signal $S_2$. On the other hand, if the temperature measured by the sensor 21 is above 110° C., the overheating detecting circuit 23 produces an output signal $S_3$. Both outputs $S_2$ and $S_3$ are supplied to the decision circuit 61 through an OR gate 24.

The decision circuit 61 changes the output signal $S_0$ in response to the signals $S_2$ or $S_3$ so that the rotational speed of the engine is, for instance, at least 1,200 r.p.m. The duty control circuit 62 controls the duty factor of the 40 Hz rectangular pulse signal in accordance with the signal $S_0$ to feed a pulse signal $P_0$ to the duty control solenoid valve 72.

The solenoid 72*b* of the duty control solenoid valve 72 is energized by this pulse signal $P_0$, thereby pressing down the plunger 72*d* against the force of the spring 72*c*.

Accordingly, the valve 72*e* provided at the end of the plunger 72*d* moves toward the opening 71*e* of the regulating control valve 71 so as to cover it. As a result, the vacuum pressure is substantially all supplied to the actuator 73. As a result, the diaphragm 73*a* of the actuator 73 is pulled down against the compression force of the spring 73*b*. Thereby, the driving rod 73*c* fixed to the diaphragm 73*a* is drawn downward to move the control lever clockwise by a predetermined amount. As a result, the opening angle of the control lever 10 is varied. Accordingly, the amount of fuel supplied to the engine from the fuel injection pump increases, so that the engine rotates at at least 1,200 r.p.m.

Thus, even when the engine is cold, the engine speed is maintained at 1,200 r.p.m., and stalling is prevented, thereby making it possible to effect warm-up. On the other hand, if the engine should be idling while in an overheated condition, the speed of the engine is increased by the change in the engine speed setting signal, thereby increasing the cooling effect of a cooling fan which rotates in synchronism with the engine, to increase heat radiation from the engine.

Thus, once the engine is warmed up (20° C.–110° C.), the cold condition detecting circuit 22 or the overheating condition detecting circuit 23 stops outputting the signal $S_2$ or $S_3$. Accordingly, the decision circuit 61 changes the output signal $S_0$ so that the rotational speed of the engine is lowered to reach a value equal to about 650 r.p.m.

The duty factor of the output signal $P_0$ of the duty factor control circuit 62 becomes zero, whereby the control lever returns to an initial position. Thus, the engine speed is maintained at the predetermined value for idling.

The operation of the engine will now be discussed in the case when the condition of the battery fitted to the vehicle is abnormal.

If the output voltage of the battery 3 becomes lower than 10 V or if an air conditioner whose power dissipation is large is switched on, the low voltage detecting circuit 41 or the air conditioner operation detecting circuit 42 feeds a signal $S_4$ or $S_5$ to the decision circuit 61 through an OR gate 43. The decision circuit 61 changes the output signal $S_0$ so that the engine rotates at a speed of at least, for example, 900 r.p.m. in response to the signal $S_4$ or $S_5$. The duty factor control circuit 62 controls the duty factor of the 40 Hz rectangular wave pulse signal inputted from the oscillator 63 in accordance with the signal $S_0$ so that the duty factor comes to a predetermined value, and outputs a corresponding pulse signal $P_0$ to the solenoid valve 72.

Thereby, in a similar way to the preceding case, the solenoid valve 72 feeds a vacuum pressure dependent on the duty factor of the pulse signal $P_0$ to the actuator 73. As a result, the driving rod 73*c* of the actuator 73 is drawn downward by an amount corresponding to the vacuum pressure. Thereby, the control lever 10 is rotated clockwise to increase the amount of fuel being injected into the engine from the fuel injection pump so that the engine rotates at a speed of at least 900 r.p.m.

As is clear from the foregoing description, when the output voltage of the battery 3 goes below 10 V, or when an air-conditioner whose power dissipation is large is switched on, the engine rotates at at least 900 r.p.m. Because of this, the power generated by the generator 9 increases, thereby to compensate the battery voltage.

When the air-conditioner is stopped or the battery is sufficiently charged up, the low voltage detecting circuit 41 or the air-conditioner operation detecting circuit 42 stops outputting signal $S_4$ or $S_5$. As a result, the engine returns to normal idling at about 650 r.p.m.

It is to be noted here that an electric motor may be used as the driving means 7 of the above embodiment. Also, of course, the various predetermined rotational speeds of the engine are not limited to those in the above description but may be set according to the requirements of various vehicles.

As seen from the preferred embodiment of the present invention, the rotational speed control device for a diesel engine is constituted so as to automatically control the rotational speed in accordance with the temperature condition of the engine and the condition of the battery. Accordingly, the control device according to the present invention makes it possible to eliminate manual operation depending on the driver's judgement, whereby the diesel engine is controlled at predetermined idling speeds. As a result, this device is advantageous in making warming-up easy, preventing excessive discharge of the battery, and preventing overheating of the engine or stalling.

While the present invention has been particularly shown and described with reference to preferred embodiments thereof, it will be understood by those skilled in the art that the foregoing and other changes in form and details may be made therein without departing from the spirit and scope of the invention.

What is claimed is:

1. An idling speed control system for a diesel engine comprising:

(a) an engine speed sensor for determining engine speed and producing a first sensor signal indicating the determined engine speed;

(b) an engine temperature sensor for determining engine temperature and producing a second sensor signal when the determined engine temperature is not in a predetermined temperature range;

(c) a battery voltage sensor determining battery voltage and producing a third sensor signal when the battery voltage drops below a predetermined level;

(d) a target engine speed determining means for determining a target engine speed and producing a reference signal indicative of the determined target engine speed;

(e) an engine speed setting circuit setting the engine speed to a predetermined speed and producing a fourth signal representative of the set speed, which, when the value of said first sensor signal is less than that of said reference signal, is set to step up the engine speed so that the engine speed becomes equal to the target engine speed, and when the engine is idling and at least one of said second and third sensor signals is inputted, said engine speed setting circuit sets the engine speed to another and increased predetermined speed to step up the engine speed so that the engine speed is accelerated to said another predetermined speed;

(f) a control means responsive to said fourth signal and controlling the amount of the fuel supplied to the engine.

2. An idling speed control system for a diesel engine as defined in claim 1, wherein said fourth signal is a substantially rectangular wave of which the duty factor is varied according to the speed set by said engine speed setting circuit.

3. An idling speed control system for a diesel engine as defined in claim 2, wherein said control means comprises a control valve consisting of a regulating pressure control valve to which a vacuum pressure is supplied, a duty factor control solenoid valve which controls an output vacuum by varying the ratio between the constant vacuum pressure regulated by the regulating control valve and air in accordance with the duty factor, and a mechanical actuator which is operated by an amount depending on the output vacuum from the control valve and controls the supply of fuel.

4. An idling speed control system for a diesel engine as defined in claim 1, wherein said engine temperature sensor comprises a coolant temperature sensor which determines the engine coolant temperature, a cold condition detecting circuit producing said second sensor signal when the determined engine coolant temperature is below a predetermined low temperature, an overheating condition detecting circuit producing said second sensor signal when the determined engine coolant temperature is above a predetermined temperature and an OR gate connected to the outputs of the cold condition detecting circuit and the overheating condition detecting circuit.

5. An idling speed control system for a diesel engine as defined in claim 1, wherein said battery voltage sensor comprises a battery voltage sensing circuit producing said third signal when the output voltage of the battery is below said predetermined level, an air conditioner operation detector producing said third signal when an air conditioner is switched on, and an OR gate connected to the outputs of the battery voltage sensing circuit and the air conditioner detector.

6. An idling speed control system for a diesel engine as defined in claim 1, wherein said engine speed sensor includes a pulse generator comprising a light source, a photocell, and a pulley in which at least one aperture is formed, said pulley rotating in synchronism with the engine.

7. An idling speed control system for a diesel engine comprising:

a first sensor means for determining engine revolution speed and producing a first sensor signal indicative of the determined engine speed;

a second sensor means for determining an engine temperature and producing a second sensor signal when the determined engine temperature is out of a predetermined engine temperature range;

a third sensor means for determining a load on the engine and producing a third sensor signal when the determined engine load is above a predetermined value;

an engine speed setting means for presetting a basic idle engine speed and producing a reference signal indicative of the preset idle engine speed;

an engine speed control circuit comparing the first sensor signal which indicates a duty factor corresponding to the difference of value between the first sensor signal and the reference signal, so that the difference between the first sensor signal and the reference signal can be reduced to zero, said engine speed control circuit producing a control signal and being responsive to said second and third sensor signals and increasing the duty factor of said control signal at a given rate when at least either one of said second and third sensor signals is inputted thereto; and a fuel supply means for controlling a fuel amount to be supplied to the engine in response to said control signal, which fuel supply means includes an electrically operative means having an energized period an deenergized period the ratio of which controls the electrically operative means, said ratio corresponding to the duty factor of the control signal.

8. An idling speed control system for a diesel engine comprising:

a fuel supply means for supplying fuel to the engine and including an electrically operative means for controlling a fuel amount to be supplied to the engine;

a first sensor means for determining an engine revolution speed and producing a first sensor signal indicative of the determined engine speed;

a second sensor means for determining engine temperature and producing a second sensor signal when the determined engine temperature is out of a predetermined range, said second sensor means including a cold engine sensing means for detecting the engine temperature being lower than a lower limit of said predetermined range and an overheating detecting means for detecting the engine temperature being higher than an upper limit of said predetermined range;

a third sensor means for determining a load on the engine and producing a third sensor signal when the determined engine load exceeds a predetermined value;

an engine speed setting means for presetting a basic engine idling speed and producing a reference signal indicative of the preset engine idling speed;

an engine speed control circuit comparing said first sensor signal and said reference signal to obtain a difference of value therebetween and producing a control signal indicative of a duty factor defining a ratio of an energized period and a deenergized period of said electrically operative means of said fuel supply means for controlling the engine speed to said preset basic engine speed, said control circuit being responsive to said second and third sensor signal and increasing the duty factor of said control signal at a given rate when either one of said second and third sensor signal is inputted thereto, so that the engine can be accelerated at a given rate.

9. An idling speed control system for a diesel engine as defined in claim 7 or 8 wherein said third sensor means detects a battery voltage dropping below a predetermined value, said third sensor means producing said third sensor signal when it detects the battery voltage below the predetermined value.

10. An idling speed control system for a diesel engine as defined in claim 9, wherein said third sensor means further detects the on and off status of an air conditioner switch and produces said third sensor signal in response to turning on of said air conditioner switch.

11. An idling speed control system for a diesel engine as defined in claim 10, wherein said fuel supply means comprises a control valve consisting of a regulating pressure control valve to which a vacuum pressure is supplied, a duty factor control solenoid valve which controls an output vacuum by varying the ratio between the constant vacuum pressure regulated by the regulating control valve and air in accordance with the duty factor, and a mechanical actuator which is operated by an amount depending on the output vacuum from the control valve and controls the supply of fuel.

12. An idling speed control system for a diesel engine as defined in claim 7 or 8, wherein said second sensor means comprises a coolant temperature sensor which determines the engine coolant temperature, a cold condition detecting circuit producing said second sensor signal when the determined engine coolant temperature is below a predetermined low temperature, an overheating condition circuit producing said second sensor signal when the determined engine coolant temperature is above a predetermined temperature and an OR gate connected to the outputs of the cold condition detecting circuit and the overheating condition detecting circuit.

13. An idling speed control system for a diesel engine as defined in claim 7 or 8, wherein said first sensor means includes a pulse generator comprising a light source, a photocell, and a pulley in which at least one aperture is formed, said pulley rotating in synchronism with the engine.

14. An idling speed control system for a diesel engine comprising:

a fuel supply means for supplying a fuel to the engine, said fuel supply means including an electrically operative fuel amount control means for controlling the fuel amount to be supplied to the engine;

a first sensor means for determining an engine speed and producing a first sensor signal indicative of the determined engine speed;

a second sensor means for determining an engine temperature, which second sensor means includes an over-heating detecting means for detecting over-heating of the engine exceeding a predetermined upper limit of the engine temperature range and a cold engine detecting means for detecting a cold engine condition in which the engine temperature is lower than a predetermined lower limit, said over-heating detecting means producing a second sensor signal in response to detecting of the overheating condition of the engine and said cold engine detector producing a third sensor signal in response to detecting of the cold engine condition;

a third sensor means for determining a battery voltage of the vehicle battery and producing a fourth signal when the determined battery voltage is lower than a predetermined value;

a target engine speed determining means in which is preset a basic engine idling speed and producing a reference signal indicative of the preset engine idling speed;

an engine speed control circuit responsive to said reference signal and said first sensor signal and producing a control signal representative of a duty factor defining the ratio of an energized period and a deenergized period of said fuel amount control means in order to reduce a difference of the determined engine speed and the preset target engine speed, said engine speed control circuit being responsive to said second and third sensor signals to increase the duty factor of the control signal in order to accelerate the engine speed at a first given rate, said control circuit further being responsive to said fourth sensor signal to increase the duty factor of said control signal in order to accelerate the engine speed at a second given rate.

15. An idling speed control system for a diesel engine as defined in claim 14, wherein said system further includes a fourth sensor means for detecting a switch position of an air conditioner switch, said fourth sensor means producing a fifth sensor signal when it detects an on position of said air conditioner switch, and said control circuit being responsive to said fifth sensor signal to increase the duty factor of said control signal in order to accelerate the engine speed at a third given rate.

16. An idling speed control system for a diesel engine as defined in claim 14, or 15, wherein said fuel amount control means comprises a control valve including an actuator electrically operative in response to said control signal, which actuator is controlled by the energized period and the deenergized period corresponding to the duty factor of the control signal, said control valve producing a control vacuum to be fed to a valve actuator operating a fuel pump for controlling the revolution speed of said fuel pump.

17. An idling speed control system for a diesel engine as defined in claim 16, wherein the revolution speed of the fuel pump is proportional to the engine speed.

18. An idling speed control system for a diesel engine as defined in claim 17, wherein said fuel pump revolution speed is one half of the engine speed.

* * * * *